United States Patent [19]

Jakobsson et al.

[11] 4,244,256

[45] Jan. 13, 1981

[54] PROFILE SHAPING APPARATUS AND METHOD

[75] Inventors: Per Jakobsson; Holger Alexandersson, both of Orebro, Sweden

[73] Assignee: Intong Aktiebolag, Kumla, Sweden

[21] Appl. No.: 43,265

[22] Filed: May 29, 1979

[30] Foreign Application Priority Data

May 30, 1978 [SE] Sweden ..... 7806191

[51] Int. Cl.[3] ..... B26D 1/547; B26D 3/00

[52] U.S. Cl. ..... 83/862; 83/875; 83/651.1; 83/861

[58] Field of Search ..... 264/138, 158; 83/875, 83/861, 651.1, 869, 862; 425/289, 301, 306

[56] References Cited

U.S. PATENT DOCUMENTS

| | | | |
|---|---|---|---|
| 693,760 | 2/1902 | Walker | 425/289 |
| 1,196,454 | 8/1916 | Hekendorn | 83/651.1 |
| 1,856,055 | 4/1932 | Hervey | 425/301 |
| 2,333,855 | 11/1943 | Goscoigne | 83/651.1 |
| 3,089,371 | 5/1963 | Spears | 425/306 |
| 3,354,546 | 11/1967 | Paglinea | 83/651.1 |

FOREIGN PATENT DOCUMENTS

| | | | |
|---|---|---|---|
| 2051180 | 3/1971 | France | 83/875 |
| 307098 | 3/1969 | Sweden . | |

*Primary Examiner*—James B. Lowe

*Attorney, Agent, or Firm*—Larson, Taylor and Hinds

[57] ABSTRACT

An apparatus for shaping profiles in the surface of a moulded semiplastic body (4) comprises a comparatively fine wire (1) extending between the free ends of a plurality of these supporting members such as needle-like supporting members (2,3) which determine the profile shape. The wire is zigzagged in such way that each individual wire portion extending between two adjacent supporting members is oblique in relation to the direction of relative movement between said body and the profile shaping apparatus itself. The apparatus produces extremely distinct profiles with good smoothness of the body surfaces. The apparatus is primarily used for shaping profiles in building units made from a body of lightweight or aerated concrete, while the body is still uncured and semiplastic.

9 Claims, 6 Drawing Figures

PROFILE SHAPING APPARATUS AND METHOD

THE GENERAL ART OF THE INVENTION

The invention relates generally to an apparatus for shaping profiles in the surface area of moulded bodies of a plastic or semiplastic material, such as uncured lightweight concrete or aerated concrete, the apparatus being of the type which operates with a relative movement between the moulded body and the apparatus itself in order to produce said profiles.

SHORT DESCRIPTION OF THE PRIOR ART

A profile shaping apparatus of the above mentioned art is previously known by the Swedish Pat. No. 307 098 which discloses how a plurality of rigid wires are attached to a rotatable shaft and bend to the form of the profiles desired in order to work as milling members when rotating the shaft, said milling members milling off the superfluous aerated concrete material while leaving the profiles desired. By the Swedish patent specification 180 171 an apparatus is further known which comprises a beam on which a suitable number of knives made of steel-wire or steel-band strips are attached, said knives quite simply cutting through the material due to the relative movement between the aerated concrete body and the knives.

Common to the prior art apparatuses within this field is that they provide a rather poor smoothness of the profile surfaces. A poor surface smoothness may be accepted in certain types of aerated concrete products, but in other products on the other hand it is most desirable than an optimum surface smoothness is achieved.

SUMMARY OF THE INVENTION

The invention has among its objects the improvement of the surface smoothness of profiled bodies of aerated or lightweight concrete towards perfection.

A further object is to achieve the surface smoothness desired without damaging the fragile uncured concrete body.

Another object of the invention is the production of profiled building units of aerated concrete which have no visible marks from the profile shaping means when finished.

The above-mentioned objects are achieved by means of an apparatus comprising at least one comparatively fine wire, which in a manner known per se extends between the free ends of a plurality of thin supporting members such as needle-like supporting members settling the profile shape, and which is zigzagged in such a way that an individual wire portion extending between two adjacent supporting members is oblique in relation to the direction of the above-mentioned relative movement between the semiplastic moulded body and the profile shaping apparatus itself.

ADDITIONAL DESCRIPTION OF THE PRIOR ART

By the Swedish Pat. Nos. 105 237 and 106 154 it is certainly previously known to arrange a wire between the free ends of a plurality of needle-like supporting members and use this arragement for the processing of aerated concrete still uncured. In these cases it is however not the question of shaping profiles in the surface layers of a moulded body to be processed, but rather to cut up a larger body into smaller pieces having a substantially parallelepipedic shape. To this end the cutting wire extends linearly, the wires being pressed into the aerated concrete body perpendicularly to the length direction of the wire by means of the supporting members on which it is held. No portions of the wire are however obliquely arranged as in the case of the present invention.

SHORT DESCRIPTION OF THE DRAWINGS

With reference to the attached drawings a closer description of an embodiment of the invention will follow hereinafter.

In the drawings, wherein like reference characters indicate like parts:

Figure 3:
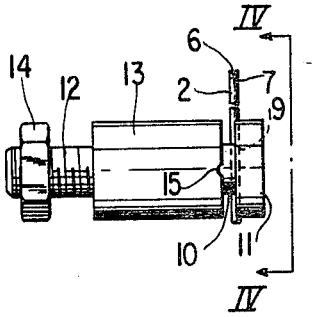
Figure 4:
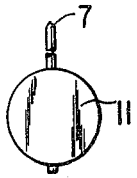
Figure 5:
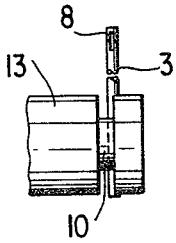
Figure 6:
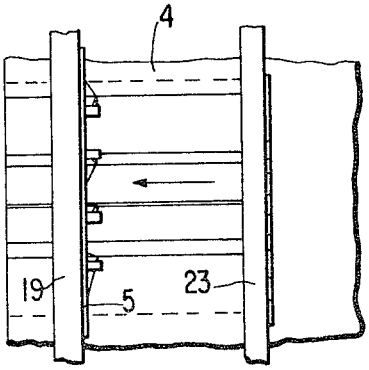

FIG. 3 is a side elevational view of a supporting member included in the apparatus, said member being shown on an enlarged scale and with certain elements thereof oriented out of their normal position so as to depict certain features, FIG. 4 is an end elevational view taken along line IV—IV in FIG. 3, FIG. 5 a partially sectioned side elevational view being similar to FIG. 3, but illustrating a second type of supporting member, and FIG. 6 a side elevational view of a portion of a lightweight concrete body during the profile shaping process using the apparatus of the invention.

Before the proper profile shaping apparatus of the invention is described in detail it should briefly be pointed out that the actual profile shaping operation can be carried out by using a technique which is conventional within the art, wherein as the body to be shaped is caused to pass stationary uprights which are located on either side of the body and on which the profile apparatuses are supported. In theory it is also possible to have moveable profile shaping apparatuses pass a stationary moulded body or to let the moulded body as well as the profile shaping apparatuses move simultaneously. Thus the essential thing is that a relative movement is provided between the moulded body and the profile shaping apparatus. This relative movement is usually, but not necessarily in the horizontal direction.

DETAILED DESCRIPTION OF A PREFERRED EMBODIMENT OF THE INVENTION

Figure 2:
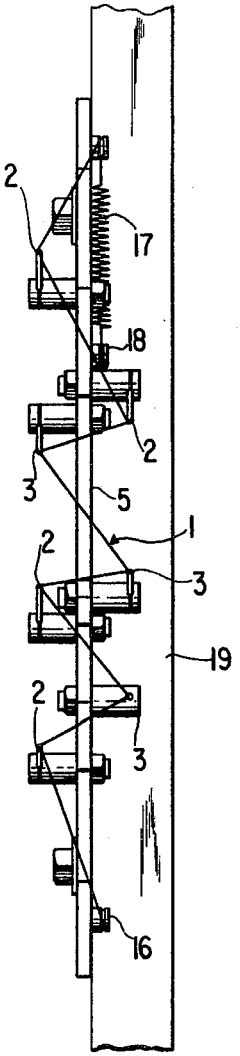
FIG. 2 is a side view of the apparatus as viewed along lines II—II in FIG. 1, but with the molded body removed.
Figure 1:
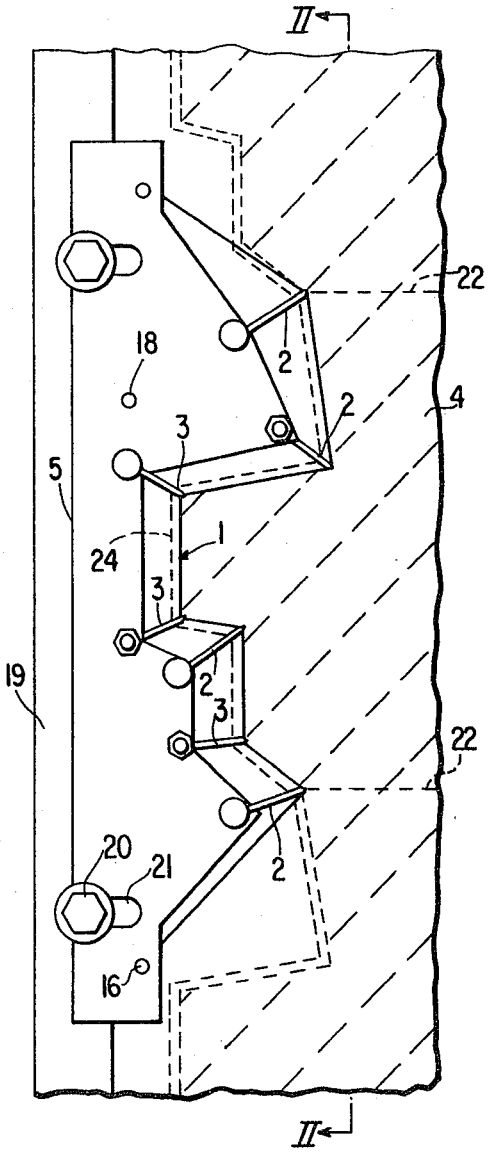
FIG. 1 is a front elevational view of the apparatus of the invention, the apparatus here being illustrated in connection with a sectioned portion of a moulded body of lightweight concrete.

The apparatus shown in FIGS. 1 and 2 comprises a wire generally designated 1 which extends between the free ends of a plurality of thin supporting or holding members designated 2 and 3 respectively. By their location in space these members determine the configuraion of the wire 1 and accordingly also the profile shape of the lightweight concrete body 4 which is being shaped. The members 2, 3 are advantageously extremely slender or fine at the free end portions thereof so as to hold the wire 1 without being the cause of any grooves or indentations of the body 4.

A frame in the form of a flat iron plate or bar 5 carries the thin supporting members 2, 3. In the embodiment shown these members consist of two different types of needles which are illustrated in detail in FIGS. 3 to 5 to which reference is now made. The first type of needle 2 shown in FIGS. 3 and 4 has an outwardly opened recess 6 in the outermost free end portion 7 of the needle for receiving the wire 1. Said end portion 7 is furthermore chamfered or bevelled in such a way that the needle terminates in an extemely fine wedge or tip (FIG. 4). Instead of a recess the needle 3 shown in FIG. 5 has a long and narrow aperture 8 which is closed outwardly and located in the vicinity of the free end of the needle. Also in this case the free end of the needle 5 is advantageously bevelled in order to form a fine tip.

Needles 2 and 3 are mounted so as to be pivotable as well as displaceable between various fixed positions of adjustment relative to the flat iron bar 5. In practice this is realized by arranging the needle in a bore 9 which extends through a pin 10 having a head 11 as well as a thread 12 at the opposite end thereof (see FIG. 3). The pin 10 is inserted in a spacing sleeve 13 which determines the space between the needle and the flat bar 5. On the threaded portion 12 of the pin a nut 14 is fit for fixing or rigidly mounting the pin and the needle in relation to the flat bar 5. The needle 2 (or 3) is freely displaceable forwardly and backwardly in the bore as long as the nut is not tightened, and thereby the distance between the end portion 7 and the center line of the pin 10 can be varied. Further the pin 10 may be rotated in relation to the flat bar, whereby the particular needle can be pivoted between different positions in space. This makes it possible to provide many different profile shapes of the wire 1. Fixing of the needle in the position desired is carried out by tightening the nut 14 on the back of the flat bar 5.

It should be noted that the spacing sleeve 13 in FIG. 13 is shown rotated a quarter of a turn in relation to its normal position so as to illustrate a groove 15 which is recessed in the end portion of the sleeve 13 for receiving the needle. It should also be noted that the depth of groove 15 is selected such that the needle will be clamped between the sleeve 13 and the head 11 when the nut is tightened.

Now reference is once again made to FIGS. 1 and 2 which illustrate how the wire 1 at one of its ends, namely the lower end is attached to a fixed knob 16. At its opposite end the wire is associated with a spring in the form of a draw spring 17 which in turn is attached to a fixed second knob 18. The wire is freely moveable in relation to the needles, or more exactly in relation to the recess 6 and the aperture 8 respectively in the needle in question. By virtue of this combination of free movability and spring loading all of the wire portions located between adjacent needles will be properly stretched. The spring arrangement also results in a substantially reduced risk of wire breakage.

As best shown in FIG. 2 the needles 2,3 are arranged in such a way that the separate straight wire portions extending between adjacent needles will be oblique in relation to the vertical and/or horizontal. By this obliqueness or zigzagged configuration it has been possible to achieve very smooth surfaces even with profiled shaping materials which otherwise are difficult to process, such as white aerated concrete, i.e. aerated concrete based on sand or other quartz-containing materials. The angle of inclination of the wire portions will of course vary in dependence of the profile desired (which also determines the different positions of the needles), but an angle of about 45° is worth aiming at.

It has been mentioned that the wire 1 should be fine. Practical tests have shown that optimal results in regard of surface smoothness/wire breakage is achieved by means of a piano type steel wire having a diameter of 0.20 mm. It is however possible to use as fine wires as 0.15 or even 0.10 mm provided that an increasing number of wire breakages can be accepted. Fewer wire breakages will occur when using wire diameters of 0.30 to 0.40 mm, but this advantageous effect is achieved at the sacrifice of surface smoothness.

With reference again to FIGS. 1 and 2, flat bar 5 which serves as a frame is shown attached to an upright 19 (consisting e.g. of square-iron) by means of screws 20 located in slots 21 in the flat bar. In practice a plurality of flat bars or frames 5 with their corresponding profiling wires 1 may be attached to each of such upright 19. Advantageously one frame is then placed on one side of the upright and the next frame (above and below respectively) on the opposite side of the upright while achieving a zigzagged arrangement. In the depicted embodiment of the invention, each individual frame is used to shape one individual roof beam or unit included in the body 4, as indicated by the dashed lines 22 in FIG. 1.

Reference is now made to FIG. 6 which illustrates upright 19 with its corresponding profiling wires 1 arranged after (compare with the arrow) a first or primary profile cutter designated 23. This primary profile cutter is used for producing initial or pre-fabricated, rough profiles in the surface of the body 4. The pre-fabricated profiles—which in FIG. 1 are indicated with the dashed line 24—may in practice be found about 3 mm outside the final surfaces produced by the profiling wires 1 of the invention. The type of profile cutter used for this pre-shaping of the body is of minor importance. Thus a rotary cutter for instance of the type disclosed in the Swedish Pat. No. 307 098 may be used for this purpose or a stationary device of the type which is indicated in FIG. 6 and which operates with strip-like knives. Other devices are conceivable too. The essential thing is that as much material as possible is peeled off in advance in order to reduce the loading on the fine wires of the final profile shaping apparatus.

It should be understood that the two profile shaping apparatuses shown in FIG. 6 have their counterpart on the opposite side of the aerated concrete body 4, the visible apparatuses producing the profile shaping of tongues in the aerated concrete material, while the apparatuses on the opposite side of the body producing grooves.

During the profile shaping the feed speed of the aerated concrete body may be about 0.15 meter/second.

It will be apparent that various immaterial modifications may be made in the invention without departing from the spirit thereof. Instead of needles as supporting members for the wire it is thus possible to use extremely thin plates which are located parallel to the direction of the relative movement between the moulded body and the profile shaping apparatus, one type of plates having in their outer edge one or possibly more recesses of the art described in connection with the needle 2, while a second type of plate has one or more apertures which are similar to the apertures 8 in the needle 3. Further it is conceivable to utilize the invention in connection with the profile shaping of other arbitrary, plastic or semiplastic materials than uncured aerated or lightweight concrete.

What is claimed is:

1. An apparatus for use in shaping profiles in the surface of a body of a semiplastic material, said apparatus being adapted in use for operating with a relative movement between the body and said apparatus in a direction along the surface of the body in order to produce said profiles, said apparatus comprising:

a plurality of thin supporting members, each of which has a free end;

at least one comparatively fine wire which extends between and is retained by said free ends of said supporting members in a predetermined orientation based on the desired profile shape, and such that said wire is zigzaggedly arranged obliquely to said direction of relative movement in such a way that an individual wire portion extending between two adjacent supporting members is oblique with respect to the direction of said relative movement between the body and said profile shaping apparatus.

2. An apparatus as defined in claim 1, wherein said apparatus is arranged after a primary profile cutter producing initial rough profiles in the surface of said moulded body.

3. Apparatus as claimed in claim 1 wherein adjacent individual portions of said wire on each side of a supporting member are reversely inclined with respect to the direction of the said relative movement.

4. An apparatus as claimed in claim 1 wherein at least one of said supporting members comprises a needle supported so as to have a free end and having an outwardly open recess in said free end for receiving said wire.

5. An apparatus as claimed in claim 4 wherein at least one other of said supporting members comprises a needle supported so as to have a free end and having an outwardly closed aperture located in the vicinity of said free end thereof for receiving said wire.

6. An apparatus as claimed in claim 4 and further comprising a frame having an orifice therein; and wherein said supporting member further includes a spacing sleeve having a bore therethrough, a threaded pin extending through said sleeve bore and extending through said frame orifice, said pin having a bore therein for receiving said needle, and a nut threadable on said pin for mounting said pin to said frame.

7. An apparatus as claimed in claim 1 and further comprising a frame; and wherein said supporting member comprises means for pivotally and displaceably mounting said supporting member in various fixed positions on said frame.

8. An apparatus as claimed in claim 7 and further including a substantially vertical upright and wherein said frame is attached to one side of said upright, said upright also being capable of having one or more frames attached thereto at the side opposite said one side thereof.

9. A method for shaping profiles using the apparatus as claimed in claim 1 comprising moving the body relative to said apparatus such that said wire engages and moves relatively along the surface of the body, and with the wire portions between adjacent supporting members being oblique to the direction of relative movement.

* * * * *